United States Patent [19]

Schmidt

[11] 4,378,171

[45] Mar. 29, 1983

[54] BALL-POINT PEN

[75] Inventor: Guenther Schmidt, Baden-Baden, Fed. Rep. of Germany

[73] Assignee: The Parker Pen Company, Janesville, Wis.

[21] Appl. No.: 188,338

[22] Filed: Sep. 18, 1980

[30] Foreign Application Priority Data

Sep. 20, 1979 [DE] Fed. Rep. of Germany ..... 2938016

[51] Int. Cl.[3] ..... B43K 7/12

[52] U.S. Cl. ..... 401/115; 401/94

[58] Field of Search ..... 401/86, 92, 93, 94, 401/99, 115, 52

[56] References Cited

U.S. PATENT DOCUMENTS

| | | | |
|---|---|---|---|
| 240,712 | 4/1881 | Hoffman | 401/94 |
| 290,684 | 12/1883 | Hoffman | 401/94 |
| 326,737 | 9/1885 | Hoffman | 401/94 |
| 335,908 | 2/1886 | Fischer | 401/115 |
| 2,845,898 | 8/1958 | Stanek | 401/94 |
| 2,913,750 | 11/1959 | Aversa | 401/115 |
| 3,050,896 | 8/1962 | Parker | 401/94 |
| 3,095,859 | 7/1963 | Levy | 401/209 |
| 3,709,620 | 1/1973 | Miyamoto | 401/52 |
| 3,994,605 | 11/1976 | McKnight | 401/99 |

*Primary Examiner*—Clyde I. Coughenour

*Attorney, Agent, or Firm*—Schwartz, Jeffery, Schwaab, Mack, Blumenthal & Koch

[57] ABSTRACT

A ball-point pen, which is retractable to about half its size when not in use, includes a substantially cylindrical housing having a retractable, plastic writing cartridge body therein. A plurality of push-button actuated, spring biased gripping elements engage the plastic body to retain the body in a retracted or extended position.

4 Claims, 1 Drawing Figure

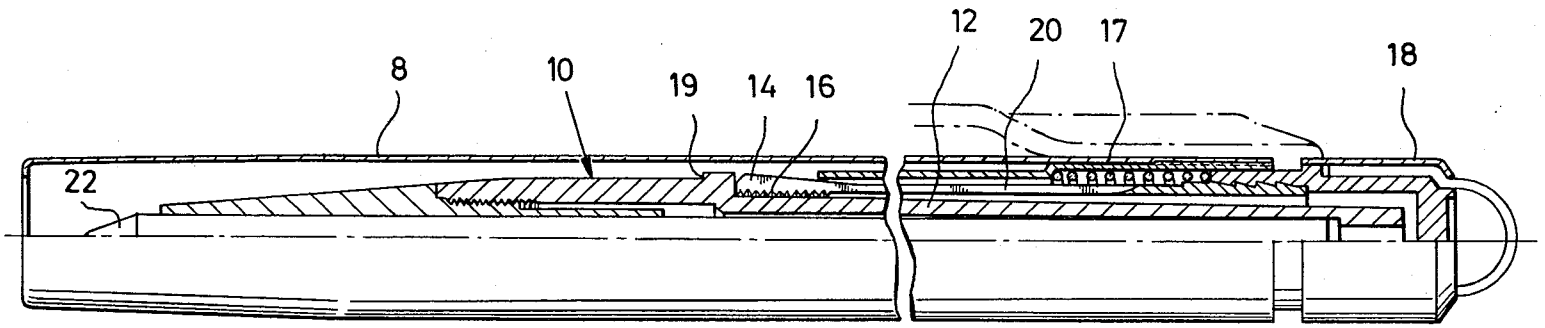
8
10
19
14
16
12
20
17
18
22

BALL-POINT PEN

BACKGROUND

1. Field of the Invention

The invention relates to a ball-point pen having a cylindrical housing and an ink-filled writing cartridge, with a writing tip capable of being brought into a writing position exterior of the housing and into an inoperative position within the housing. This is accomplished by moving the cartridge by means of a spring-loaded pushbutton disposed at the end of the housing remote from the writing tip.

2. Prior Art

Ordinarily, with such ball-point pens the ink-filled writing cartridge is guided and disposed inside the pen housing such that upon a first depression of a pushbutton the writing tip moves slightly outward beyond the end of the housing remote from the pushbutton, whereupon the pen can be used. Upon a second depression of the pushbutton the cartridge is retracted back into the housing. Such ball-point pens have generally proven practical, but they have a definite disadvantage in that it is not possible to substantially shorten the overall length of the pen in the out-of-use position (as is desirable for many applications such as when the pen is to be carried in a woman's evening purse) without at the same time also shortening the effective length of the pen in the use position. A shortened pen is undesirable because writing is made more difficult.

OBJECTS AND SUMMARY

The objective underlying the invention is to devise a ball-point pen of the general type described wherein the overall length of the pen in the out-of-use position is substantially less than that in the use position, wherein the writing cartridge is reliably housed within the housing in the out-of-use position. Whereas, in the writing position, the cartridge is securely and rigidly supported and housed in the housing, in order to furnish a stable writing instrument for writing.

This objective is achieved according to the invention wherein the writing cartridge is in the form of a substantially cylindrical retractable body, similar to a retractable lead pencil cartridge, wherein gripping elements of a clamping claw, actuatable by the pushbutton, grip the circumferential wall of the cylindrical body so as to produce a friction lock.

It is particularly advantageous if the circumferential wall of the retractable body is formed of a plastic material which has a surface which is elastically deformable by the gripping of the gripping elements.

The invention is based on the discovery that one may successfully devise a ball-point pen with an overall length in the out-of-use position which is approximately only half its overall length in the use position, with the pen having its writing cartridge acted upon by a clamping claw via the push button, similar to retractable lead pencils with lead cartridges of the known type. In this way, one ensures that in the out-of-use position the writing cartridge is reliably housed and protected within the housing, while at the same time in the use position the cartridge and housing are securely and stably joined, enabling problem-free writing. The ball-point pen of the instant invention occupies very little space in the out-of-use position, and can be easily carried in, for example, handbags, or in holding devices suitable for note pads or the like.

It is particularly advantageous if, as provided in a further embodiment of the invention, the plastic circumferential wall of the retractable body tapers conically toward its end, near the end of the body which is remote from the writing tip. In this way the grip of the clamping claw on the retractable body is improved. The conical shape results in a pressing force while writing which pushes the writing cartridge ever more tightly into the gripping elements of the clamping claw, so that it is practically impossible for the cartridge to slip inside the housing while one is writing.

BRIEF DESCRIPTION OF THE DRAWING

The above and other features and advantages of the invention will be seen from the claims, and from the following description and accompanying drawing, wherein:

The drawing (one FIGURE) shows one embodiment of the inventive ball-point pen in cross section.

DETAILED DESCRIPTION

As seen in the drawing, the illustrated embodiment has a housing 8 inside of which a retractable body 10 is disposed having a writing element therein, which writing element may be, for example, a familiar ball-point pen cartridge. A circumferential wall 12 of the retractable body 10 in the illustrated embodiment is formed of a plastic material, the surface of which is elastically deformable. A plurality of gripping elements 14 hold the retractable body 10 securely and rigidly inside housing 8, in the out-of-use position shown in the FIGURE. The gripping elements 14 press firmly against the cylindrical circumferential wall 12 of retractable body 10 with a plurality of contact surfaces 16 which have screw-thread-like indentations or shallow circumferential grooves therein. The pressing action of the gripping elements 14 is obtained from a spring 17. When a push button 18 is pressed and the other end of the pen (on the left in the FIGURE) is held in a downward direction, retractable body 10 "falls" or slides out of housing 8 until a lug or stop edge 19 engages an inner ring-shaped projection on the housing 8. (The projection is shown at the left in the FIGURE.) Upon release of push button 18, clamping claw 20 with its gripping elements 14 now lies firmly against the cylindrical circumferential wall of retractable body 10, wherein the plastic material of body 10 is elastically deformed on its surface, so that any sliding back of body 10 during writing is reliably prevented by the interaction of body 10 and the thread-like configuration of contact surfaces 16 of gripping elements 14.

After use of the writing element, the body 10 may be retracted back into the housing as shown in the FIGURE. To retract the body, the writing tip 22 and body 10 are pointed upwardly and the push button is then pushed. The retractable body will slide back into the housing 8 due to the loosening of gripping elements 14 against wall 12. After sliding the body back into the housing, it is again held tightly therein.

While several embodiments of the invention have been described, it will be understood that it is capable of still further modifications and this application is intended to cover any variations, uses, or adaptations of the invention, following in general the principles of the invention and including such departures from the present disclosure as to come within knowledge or customary practice in the art to which the invention pertains, and as may be applied to the essential features hereinbefore set forth and falling within the scope of the invention or the limits of the appended claims.

I claim:

1. A ball-point pen comprising:

(a) a substantially cylindrical housing having an ink-filled writing cartridge therein, said writing cartridge being in the form of a retractable plastic elastically deformable body and having a writing tip at one end, said body tapering substantially conically inwardly toward the end of the body away from said writing tip, (b) a plurality of gripping surfaces positioned in said housing adjacent to and external to said body, said surfaces having shallow grooves therein indented in a screw thread manner, (c) means for biasing said gripping surfaces into contact with said body and frictionally locking said body in a desired position, and (d) a push button in said housing for controlling the biasing of said gripping surfaces whereby when said cartridge is in its writing position, the pressure of said gripping surfaces on said body prevents said body from moving to its retracted position.

2. A pen as defined in claim 1 wherein said gripping surfaces substantially surround said body.

3. A pen as defined in claim 1 wherein said body has a substantially cylindrical wall formed of an elastically deformable plastic surface for gripping by said gripping surfaces.

4. A pen as defined in claim 1 or 3, wherein said means for containing ink is a ball-point ink cartridge.

* * * * *